United States Patent [19]

Brill

[11] Patent Number: 4,876,828

[45] Date of Patent: Oct. 31, 1989

[54] ARCHED, TRANSLUCENT COVERS FOR SPORT GROUNDS, SWIMMING POOLS, HOTHOUSES AND THE LIKE

[76] Inventor: Uri Brill, 77 Sweden Street, Haifa, Israel

[21] Appl. No.: 147,898

[22] Filed: Jan. 25, 1988

[30] Foreign Application Priority Data

Sep. 29, 1987 [IL] Israel ..... 83837

[51] Int. Cl.[4] ..... E04B 7/08; E04B 7/16

[52] U.S. Cl. ..... 52/23; 52/66; 52/86; 52/222; 52/469

[58] Field of Search ..... 52/63, 64, 66, 67, 71, 52/86, 23, 222, 469, 395; 47/17

[56] References Cited

U.S. PATENT DOCUMENTS

| | | | |
|---|---|---|---|
| Re. 30,044 | 7/1979 | Huddle | 52/63 |
| 1,896,433 | 2/1933 | Windeknecht | 52/67 |
| 2,914,776 | 12/1959 | Hotz | 52/23 X |
| 3,531,899 | 10/1970 | Bartlett | 52/222 X |
| 4,175,361 | 11/1979 | Kumode | 52/66 |
| 4,683,686 | 8/1987 | Ozdemir | 52/63 X |

*Primary Examiner*—David A. Scherbel

*Assistant Examiner*—Richard E. Chilcot, Jr.

*Attorney, Agent, or Firm*—Frishauf, Holtz, Goodman & Woodward

[57] ABSTRACT

A translucent cover for swimming pools, hothouses and the like comprises, a rigid supporting structure covered by rectangular panels (4) of polycarbonate sheeting. The structure comprises a number of rigid arcuate ribs (1) interconnected in parallel distanced alignment by purlins (2). The ribs are bent into arcuate shape from channels (10) open towards the outside of the cover, each rib having two co-planar flanges (11) extending along both sides of the channel opening. The panels (4) are of a width so as to cover the distance between two adjacent ribs with their two opposite margins resting on the flanges, and are held in position and pressed onto the flanges by means of flexible strips (3). The strips are of a width equal to the distance between the outer edges of the flanges (11) and of a length somewhat shorter than the length of the ribs. Each strip is lengthwise tensioned at both ends by tensioning screws fastened to the arc-shaped ribs close to their bases near the ground, whereby they press the panel edges onto the flanges and secure them in position on the structure by friction.

22 Claims, 8 Drawing Sheets

ARCHED, TRANSLUCENT COVERS FOR SPORT GROUNDS, SWIMMING POOLS, HOTHOUSES AND THE LIKE

BACKGROUND OF THE INVENTION

The invention relates to arched, translucent covers for hothouses, swimming pools, tennis courts and other facilities. It relates more particularly to arched other composed of several parallel sections which are adapted to be nested one into another at one end of the covered area, in order to expose the ground or pool to the open air, weather allowing.

Translucent covers of the aforementioned kind are known to the art; they consist generally of a number of rigid girders in arch-shape which are interconnected, either to form a complete, non-openable cover or which are transferable to one end of the area, whereby the material covering the structure is in the form of pliable plastic sheets which fold and hang down between each pair of girders.

Roofs for hothouses are known to comprise a structure of parallel, rigidly interconnected ribs bent from galvanized tubes covered by polyethylene sheeting which is fastened to the tubes by riveting, bolting or the like. However, these are generally suitable for small spans only.

Still other translucent covers comprise plane or corrugated panels of polycarbonate, fastened to steel structures of various designs.

It is the object of the present invention to provide translucent, arched covers of large spans, which can be rapidly erected and dismantled and which do not require fastening of translucent sheet material by means of bolts and rivets, with inherent drilling and tapping on site.

It is another object to provide such arched covers in sections of slightly different arch-dimensions which are movable along the sides of the covered area and nestable one in another at the end of the covered area leaving the swimming pool or other sports ground open to the fresh air.

It is still another object to produce the components of the structure of pressed, rolled or extruded bar material which lends itself to ready bending into arcuate shape, instead of the hitherto known girders which are far from being labour-efficient.

SUMMARY OF THE INVENTION

A translucent, arched cover according to the invention comprises a supporting structure including a plurality of rigid, arcuate ribs of uniform cross section held in parallel, distanced alignment by purlins, each rib being bent from a channel bar containing two parallel, co-planar flanges on both sides of the channel extending along the outside of the structure, a plurality of rectangular panels of a translucent, semi-rigid material of a length coextensive with the length of a rib and of a width coextensive with the distance between adjacent ribs, each panel being positioned with its margins on and along the flanges of two adjacent ribs, a plurality of flexible strips, one strip for each rib, of a width corresponding to the width of the channel bar across the two flanges, and of a length somewhat shorter than the length of the corresponding rib, the ends of each strip being provided with tension means cooperating with the end portions of the respective rib, wherein each strip is positioned along the outside of a rib covering the margins of a panel or panels positioned on and along the flanges of the channel bar and is tensioned on the panel or panels and the rib by the tensioning means, thus securing the panels to the ribs by pressure and friction.

In a preferred embodiment of the panel-securing-means longitudinal gasket strips are positioned between the flanges and the panel margins and between the panel margins and the flexible strip, before tensioning of the strip, in order to ensure watertightness of the cover and to increase frictional adherence of the contacting parts.

In another preferred embodiment the purlins between each two ribs are slightly curved in outward direction, thus effecting a corresponding curvature of the panels with resulting increased strength against buckling. Another effect of the outward curvature of the panels is draining of rainwater, dew or condensed vapour towards the channels in the ribs which are, advantageously, provided with drainage piping at their both ends in contact with the ground.

An openable cover of the invention comprises several sections, each of slightly different arch dimensions and of—preferably—equal longitudinal dimensions, each section comprising, for instance, four arched ribs and three panels. During clement weather all sections can be shifted along the ground and nested one in another in the end section of largest arch-dimensions.

The movable sections are preferably provided with wheels permitting their ready shifting along a concrete floor. This is in contra-distinction to the hitherto known sectional roofs, which are shifted on rails laid to both sides of the pool or sports ground.

The panels are preferably made of double-layer polycarbonate sheeting, but any other translucent, semi-rigid material may also be used.

The strips may either be in the shape of thin flats of metal, galvanized steel or an aluminum alloy, or they may be provided with a longitudinal, inwardly extending ridge serving as a guide in the channel of the curved rib.

The tensioning means at the ends of the strips are preferably in the form of a bolt and nut cooperating with a perforated lug at the lower end of the respective rib. In most cases such bolts and nuts are provided at both ends of the strip in continuation of the strip axis. By tensioning the nut on the bolt the strip is tensioned over its total length and presses down on the panel margins. Replacing of a damaged panel can be done without any drilling or tapping, by simply unscrewing the nut and lifting the strip off the panel, and by tensioning the strip again after replacement of the panel.

DETAILED DESCRIPTION OF THE DRAWINGS

Figure 1:
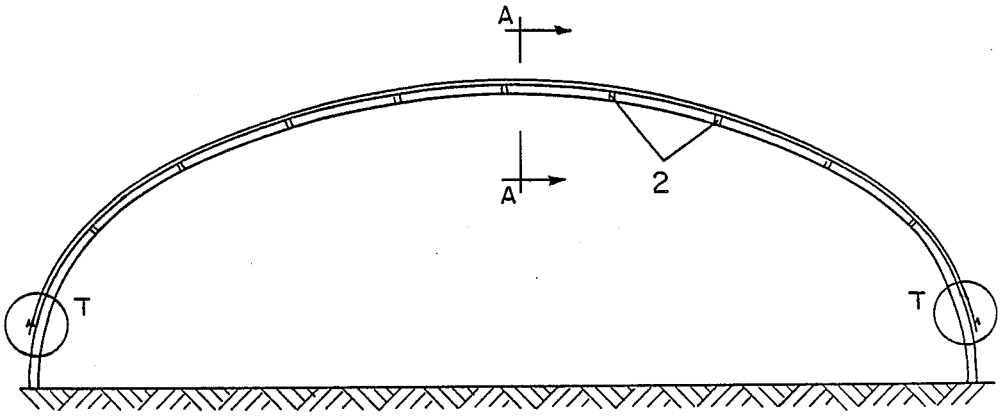
FIG. 1 is a diagrammatical vertical section through a translucent, cover, showing one arcuate rib.

The diagrammatic section of a translucent cover shown in FIG. 1 shows one arcuate rib 1, a plurality of bar-shaped connectors or purlins 2 extending between adjacent ribs and connected to these at both ends in order to maintain the correct distance therebetween. A strip 3 covers the entire rib except for the two lower ends adjacent the ground level and secures two translucent panels 4 by being tensioned on the rib by tensioning means T at both ends of the strip and the panels.

Figure 2:
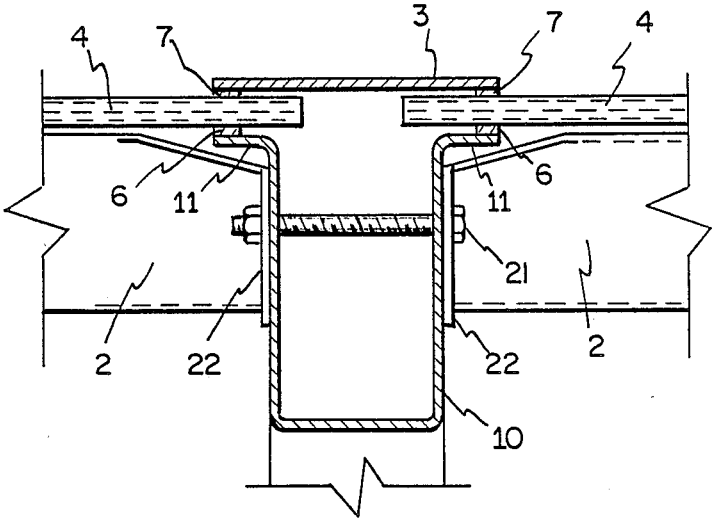
FIG. 2 is an enlarged section through a rib of the cover shown in FIG. 1 along the line A—A.

FIG. 2 shows a cross section through a rib which is in the shape of a rectangular trough 10 with outwardly extending flanges 11. The rib is connected to the two adjacent ribs of similar design by a number of horizontal purlins 2, by means of a through-going bolt 21 extending through end flanges 22 welded to the ends of each purlin. Two translucent panels 4 of a semi-rigid material, such as polycarbonate, are positioned with their margins on the flanges 11 with a resilient gasket strip 6 interposed along the entire length of each panel. The panel edges are spaced from each other, and are covered by a flexible strip 3 which, in the shown embodiment, is in the form of a flat metal strip; gasket strips 7 are positioned between each panel margin and the strip 3, opposite the gasket strips 6.

Figure 3:
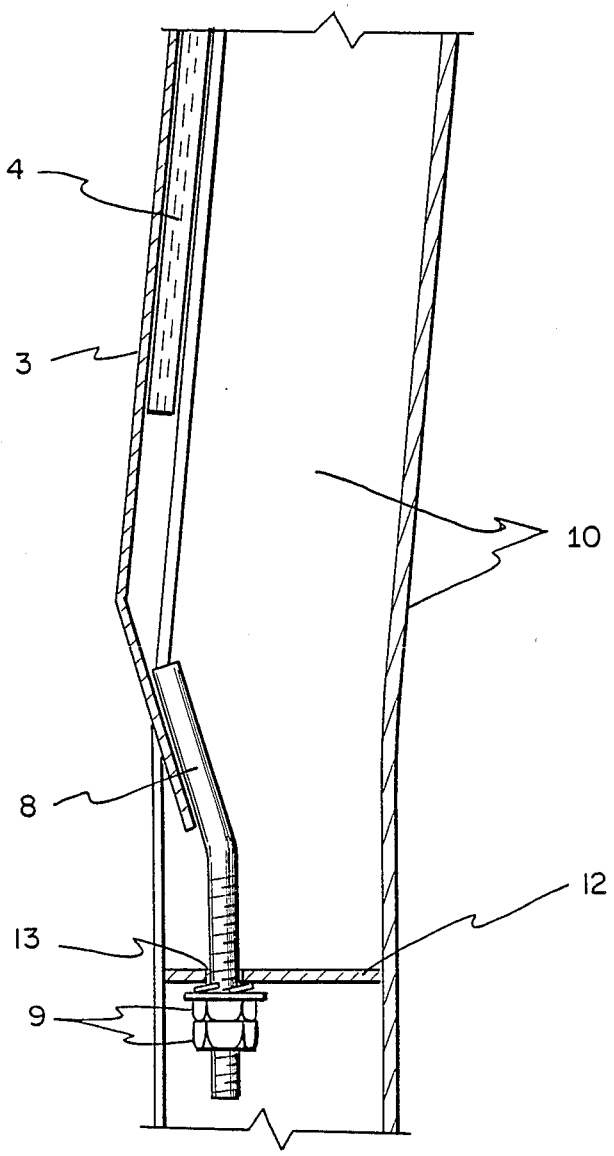
FIG. 3 is an enlarged view of the detail T of FIG. 1 showing tensioning means of a strip along a channel-shaped rib.

FIG. 3 shows one tensioning means at the end of a strip 3 in the shape of a screw-threaded bolt 8, welded to the inside of the strip, as well as two nuts 9. The bolt is held in position by a perforated lug 12, welded into the channel 10 near its bottom end, is threaded through a hole 13 in the lug 12 and tightened by means of the nuts 9.

Figure 4:
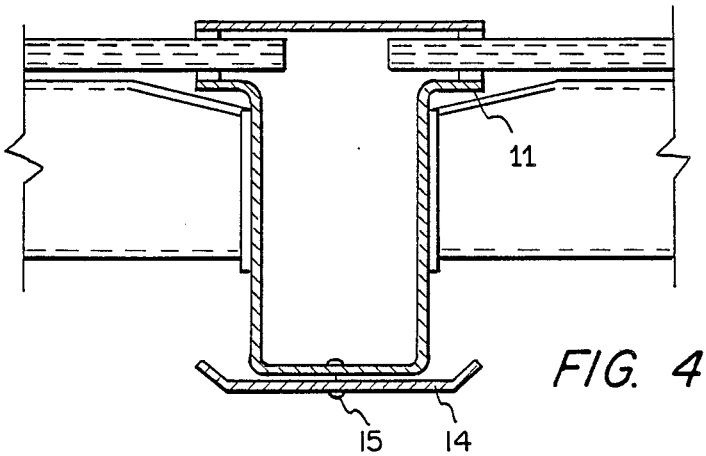
FIG. 4 is a cross section through a rib similar to that illustrated in FIG. 2, provided with a gutter serving to prevent condensate from dripping on the floor.

FIG. 4 shows the addition of a gutter 14 of thin sheet metal or plastics attached to the underside of the channel 10 by rivets 15. All other components shown in this Figure are identical with those shown in FIG. 2 and are, therefore, not separately numbered.

Figure 5:
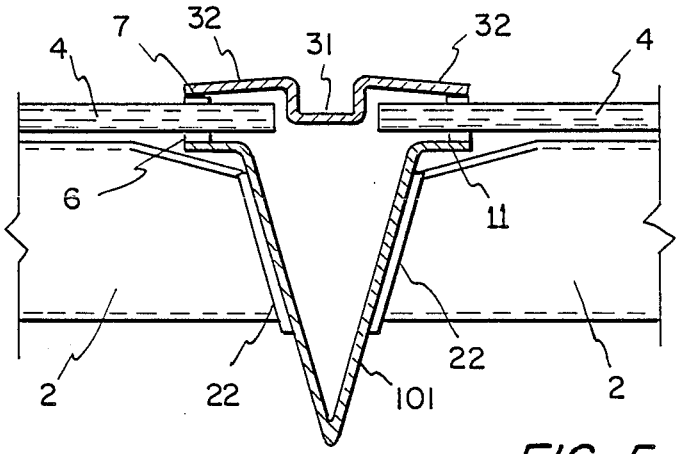
FIG. 5 shows another embodiment of a rib, of triangular cross section.

The rib 101 of FIG. 5 is in V-shape, from the upper ends of which extend two horizontal, coplanar flanges 11. The purlins 2 are similar to those of FIG. 3, but their end flanges 22 are inclined to the purlin axis at the, angle of the rib sides to permit connection by bolts or rivets. The strip 3' in this embodiment—which is shown before tensioning—differs from the flat strip 3 by its corrugated cross section; it consists substantially of a central channel 31 and two flanges 32 which are—in untensioned state—slightly sloping downwards from the channel tops. In tensioned state which is not shown in this Figure—these flanges are straightened into co-planar alignment and the channel is caused to enter the gap between the panels 4 and serves as guide. The remaining components are, again, identical with those shown in FIG. 2.

Figure 6:
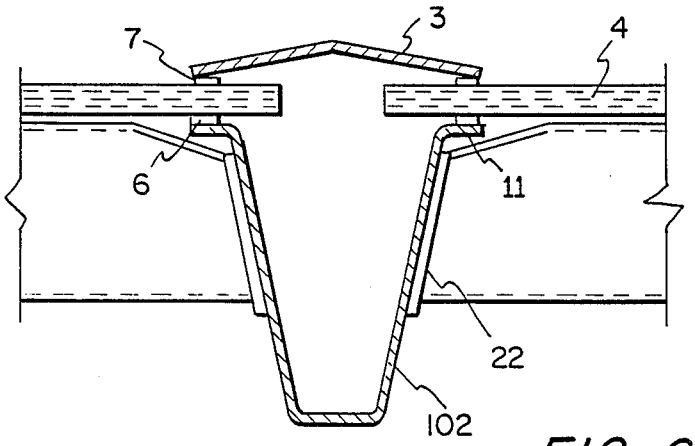
FIG. 6 shows still another embodiment of a rib of trapezoidal cross section.

FIG. 6 shows a rib 102 of trapezoidal cross section, i.e. the sharp bottom corner shown in FIG. 5 is modified into a flat bottom, a matter dictated by the kind of production of this section. The other modification shown is the strip 3 which is not completely flat but has its center portion slightly raised—in non-tensioned state. In tensioned state it will be straightened into a flat strip and tightly adhere to the underlying panels.

Figure 7:
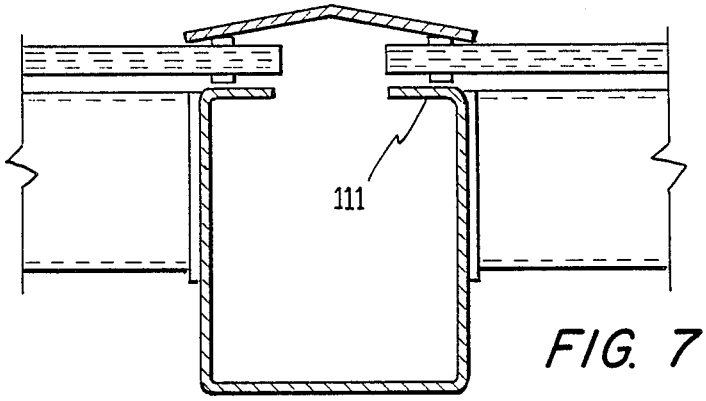
FIG. 7 shows an embodiment of a rib in the form of a rectangular channel with inwardly extending flanges.
Figure 8:
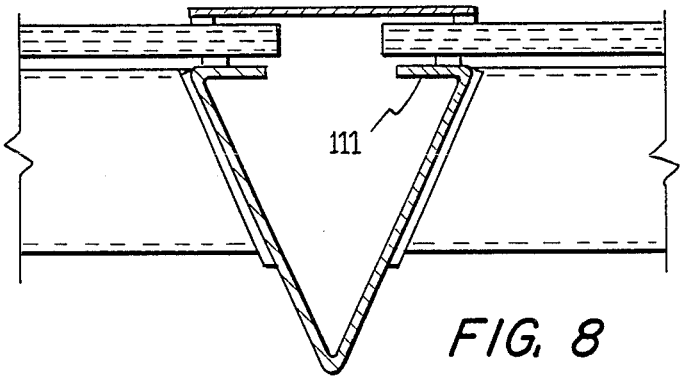
FIG. 8 shows a rib of triangular cross section with inwardly extending flanges.
Figure 9:
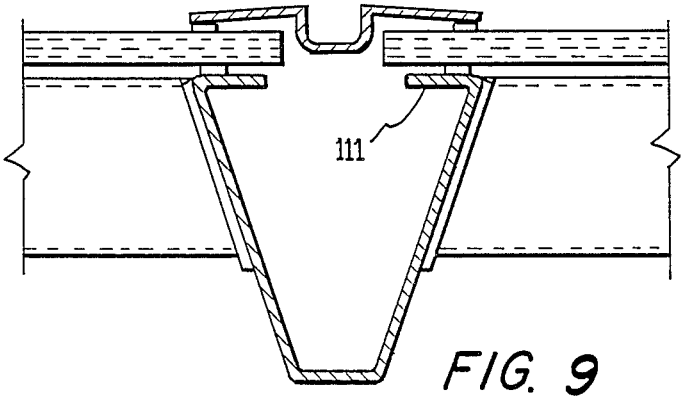
FIG. 9 shows a rib of trapezoidal cross section with inwardly extending flanges.

The cross sections shown in FIGS. 7, 8 and 9 are similar to those illustrated in FIGS. 2, 5 and 6 respectively, with the difference that the flanges 111 extend inwardly of the channel instead of outwardly. The strip in FIG. 7 corresponds to that of FIG. 6, the strip of FIG. 8 to that of FIG. 2, and the strip of FIG. 9 to that of FIG. 5. The remaining components are identical with those of the aforedescribed embodiments.

Figure 10:
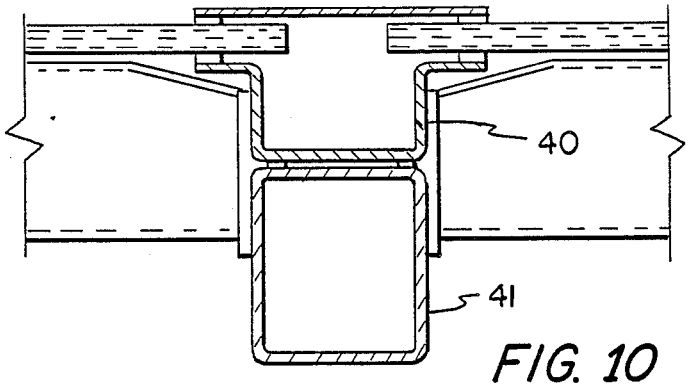
FIG. 10 shows a composite rib of rectangular cross section.
Figure 11:
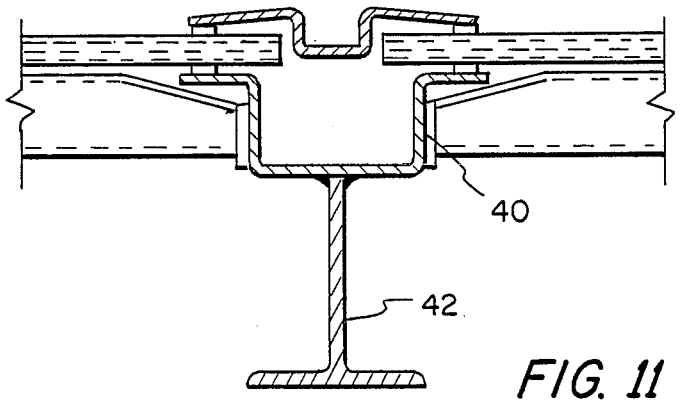
FIG. 11 shows a composite rib assembled from an open channel and a Tee-section.
Figure 12:
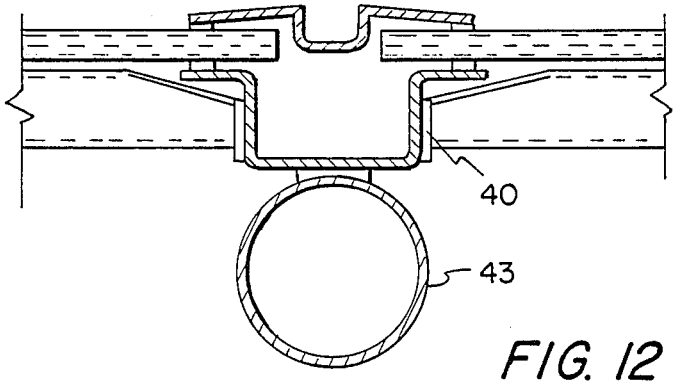
FIG. 12 shows a composite rib assembled from an open channel and a tube.

In a similar way the embodiments illustrated in FIGS. 10, 11 and 12 contain strips of the kind shown in FIGS. 7 through 12, but differ in the cross section of the rib proper:- The rib of FIG. 10 is composed of a flanged channel section 40 and a hollow, square bar 41 connected by welding or riveting.

The rib of FIG. 11 is composed of a flanged channel 40 and a T-bar 42, while the rib of FIG. 12 contains a flanged channel 40 and a tube 43, similarly connected.

Figure 13:
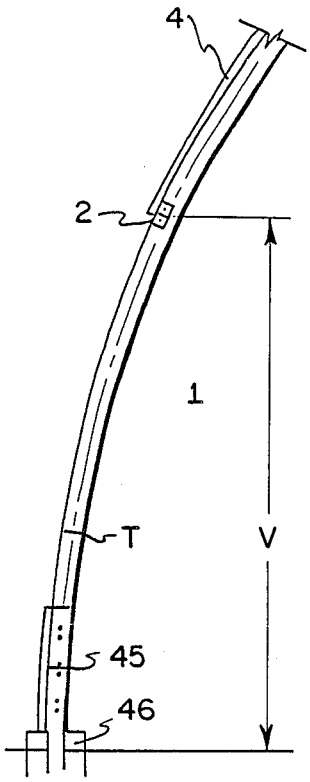
FIG. 13 illustrates the firm connection of a rib to a concrete foundation.

A rigid connection of a rib 1 to the ground is shown in FIG. 13, comprising a rigid stanchion 45 cast in a concrete. foundation ,46 and connected to the rib by rivets. The..Figure.a-so1 shows that the panels 4 do not cover the lower portions of the cover, but leave an open ventilation space V which may be covered by curtains or doors if necessary. Accordingly, the tensioning means T—which are shown diagrammatically only—are positioned above the ventilation space.

Figure 14:
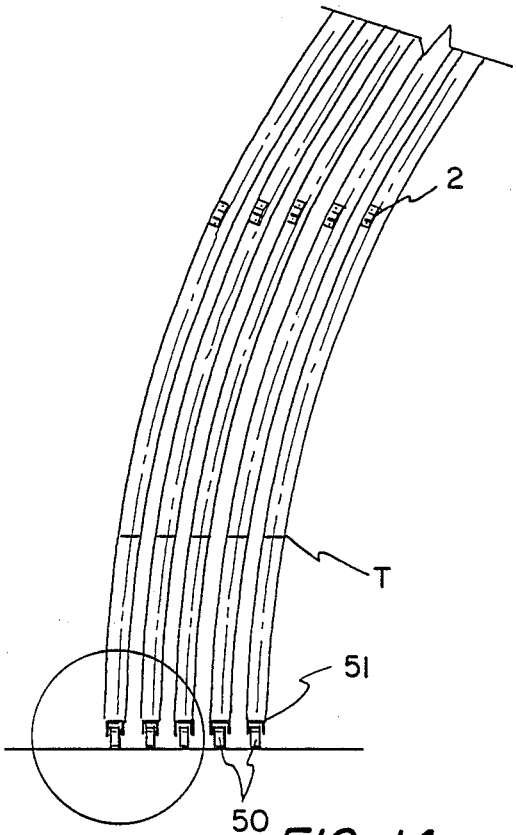
FIG. 14 is a section of a translucent, openable cover, showing five sections nested in each other.
Figure 15:
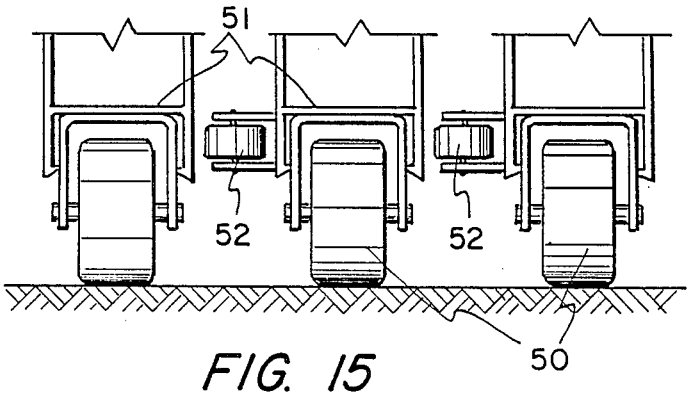
FIGS. 15 and 15*a* show one of the lower ends of three nested sections as shown in FIG. 14, and FIG. 15 illustrating the road wheels, in detail.
Figure 15A:
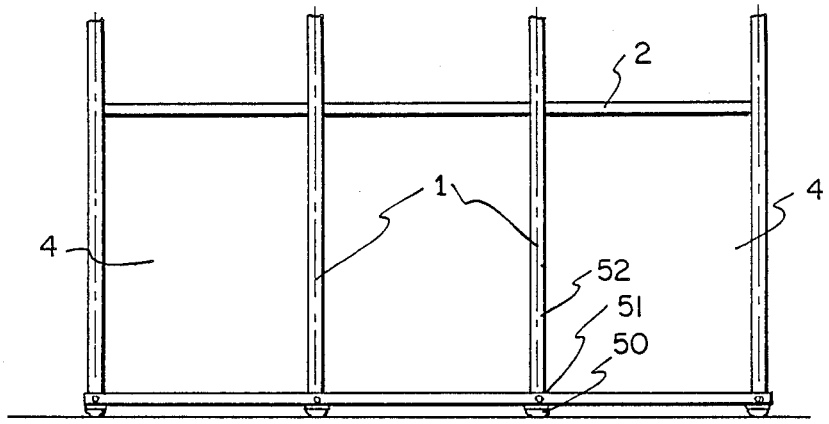

FIGS. 14, 15 and 15*a* illustrate one side of a removable cover composed of five sections which may be pushed along the floor and nested in each other at the end of the area. Each section is composed of four to five ribs which are interconnected at their bottom ends by one inverted channel 51 each and are covered by three to four translucent panels; a pair of wheels 50 are fastened to the channels 51 on each side, in straight alignment, and facilitate the longitudinal movement of each section. Guide rolls 52 are adapted to keep the necessary distance between nested sections by contact with the inverted channels 51.

Figure 16:
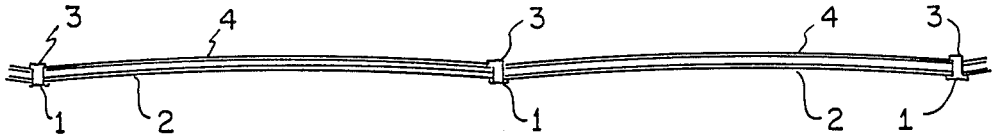
FIG. 16 is a longitudinal section through the translucent cover of FIG. 1, showing purlins and panels of upward curvature.
Figure 17:
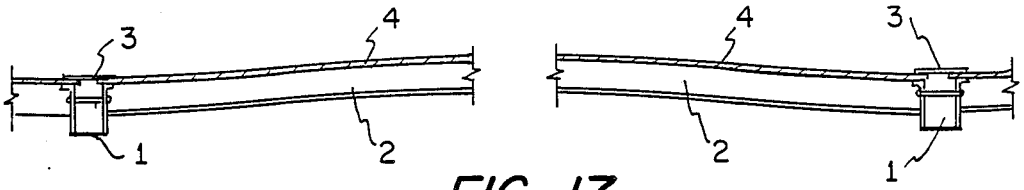
FIG. 17 is an enlarged section of a span between two ribs, illustrating the connection between purlins and ribs in detail.
Figure 18:
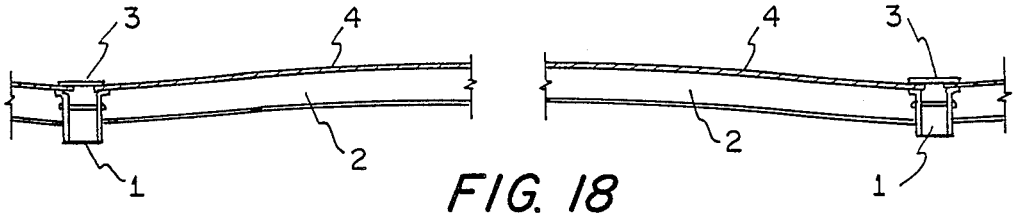
FIG. 18 is a modification of the connection between purlins and ribs.
Figure 19:
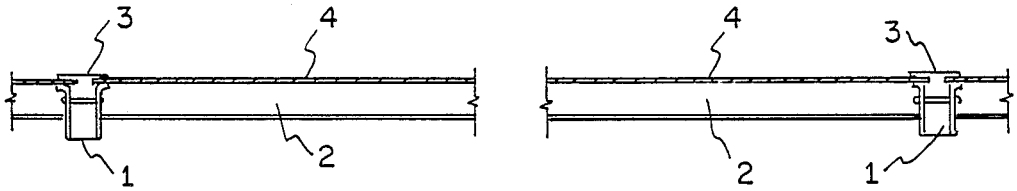
FIG. 19 is a side view of a straight purlin.

The purlins 2 connecting the ribs 1 are preferably slightly arcuate in upward direction which causes the panels to adopt arch-shape. Hereby the resistance of the panels against wind-forces is increased and rainwater is conveyed into the channels of the ribs. The arrangement is shown diagrammatically in FIG. 16 and in detail in FIGS. 17 and 18.

It will be understood that the aforedescribed embodiments represent only a few examples of the various types of translucent covery to be constructed in accordance with the invention, and that they may undergo various modifications and alterations within the scope of the appended claims.

For example, the tensioning means may be of any other known kind that shown in the drawings, such as for instance turnbuckles.

Likewise the purlins may be substituted by other connecting means or bars, and so may be the road-wheels and guide rollers.

I claim:

1. A translucent arched cover for swimming pools, sport grounds, hothouses and the like comprises a supporting structure including a plurality of rigid, arcuate ribs of uniform cross section held in parallel, distanced alignment by a plurality of purlins extending between two adjacent ribs, each said rib being bent from rigid bar material containing an outwardly extending channel and two parallel coplanar flanges on both sides of said channel extending along the outside of said structure, a plurality of rectangular panels of a translucent, semi-rigid material of a length slightly shorter than the length of said ribs and of a width coextensive with the distance between two adjacent ribs, each said channel being positioned with its longitudinal margins on and along said flanges of two adjacent ribs, a plurality of flexible strips, one strip for each said rib, of a width coextensive with the width of said rib across said two flanges and of a length corresponding to the length of said translucent panels, the ends of each said strip being provided with tension means cooperating with the lower portions of the corresponding rib, wherein each said strip is positioned along the outside of a rib covering the margins of said panel or panels positioned on and along said flanges of said rib, and is tensioned on said panel or panels by said tensioning means, thus securing said panels to said ribs by pressure and friction.

2. The translucent cover as defined in claim 1, comprising longitudinal gaskets positioned between said margins of said translucent panels and said flanges.

3. The translucent cover as defined in claim 1, comprising longitudinal gaskets positioned between said flexible strip and said margins of said translucent panel.

4. The translucent cover as defined in claim 1, comprising said purlins of slight outwardly directed curvature.

5. The translucent cover as defined in claim 1, comprising tensioning means for said strip which includes one screw-threaded bolt each attached to one end of said flexible strip, extending through a perforation in a lug integral with said rib and at least one nut serving to tension said strip onto said panels and said rib by tightening said bolt and said strip towards said lug on said rib.

6. The translucent cover as defined in claim 1, comprising purlins connected to adjacent ribs by bolts extending through flanges at both ends of each said purlin and through said rib.

7. The translucent cover as defined in claim 1, comprising gutters attached to the inside of each said rib.

8. The translucent cover as defined in claim 1, comprising translucent panels made of double-layer polycarbonate sheeting.

9. The translucent cover as defined in claim 1, comprising flexible strips made of steel sheeting.

10. The translucent cover as defined in claim 1, comprising flexible strips each in the shape of a central channel with two flanges extending sideways from said channel, said channel serving to enter a gap between two adjacent panels.

11. The translucent cover as defined in claim 1, comprising ribs of rectangular cross section.

12. The translucent cover as defined in claim 1, comprising ribs of V-shaped cross section.

13. The translucent cover as defined in claim 1, comprising ribs of trapezoidal cross section.

14. The translucent cover as defined in claim 1, comprising ribs each of channel cross section with two flanges extending outwardly from the upper ends of said channel.

15. The translucent cover as defined in claim 1, comprising ribs each o±channel cross section with two flanges extending inwardly from the upper ends of said channel.

16. The translucent cover as defined in claim 1, comprising ribs manufactured from a channel-shaped bar and a bar of different cross section.

17. The rib of claim 16, wherein said bar connected to said channel is of closed box-shape.

18. The rib of claim 16, wherein said bar connected to said channel is a T-bar.

19. The rib of claim 16, wherein said bar connected to said channel is a tube.

20. The translucent cover as defined in claim 1, comprising several sections of slightly different dimensions, suitable for all said sections to being nestable one in each other at the end of the area previously covered by said sections in parallel alignment.

21. The translucent cover as defined in claim 20, wherein each said section is provided with road wheels on both sides to permit ready longitudinal shifting of each said section.

22. The translucent cover of claim 20, wherein each said section is provided with lateral guide rolls serving to maintain distance between adjacent sections during their nesting movement.

* * * * *